United States Patent [19]

Hausmann

[11] 4,051,797

[45] Oct. 4, 1977

[54] STEEL BOAT HULL SALVAGING ASSEMBLY

[76] Inventor: Erich Hausmann, 1025 S. Westlake, Los Angeles, Calif. 90006

[21] Appl. No.: 704,058

[22] Filed: July 9, 1976

[51] Int. Cl.[2] ..... B63C 7/08; B63C 7/18

[52] U.S. Cl. ..... 114/51; 114/53; 114/55; 114/222

[58] Field of Search ..... 114/51, 52, 53, 55, 114/16.8, 222

[56] References Cited

U.S. PATENT DOCUMENTS

| | | | |
|---|---|---|---|
| 1,388,545 | 8/1921 | Bohan | 114/55 |
| 2,189,439 | 2/1940 | Temple | 114/51 |
| 2,384,580 | 9/1945 | Wertheimer | 114/51 |
| 3,033,149 | 5/1962 | Ashinger | 114/51 |
| 3,088,429 | 5/1963 | Johannessen | 114/222 |
| 3,354,658 | 11/1967 | Leonardi | 114/16.8 |

FOREIGN PATENT DOCUMENTS

| | | | |
|---|---|---|---|
| 913,620 | 9/1946 | France | 114/53 |

*Primary Examiner*—Trygve M. Blix
*Assistant Examiner*—Gregory W. O'Connor

[57] ABSTRACT

An assembly of components that may be used in combination with a salvage vessel to raise a sunken vessel that has a steel hull from the floor of the ocean or other body of water. The sunken vessel is loosened from the ocean floor by detonating explosive charges embedded in the ocean floor by remotely operated devices while the vessel itself is fastened to hoisting cables using explosive charges to drive rivets or bolts into prepared areas of the sunken hull. The sunken vessel is drawn up towards the water's surface while two elongate propeller driven containers of variable buoyancy with a support net therebetween are provided to aid in raising the sunken vessel to a position adjacent the salvage vessel.

2 Claims, 9 Drawing Figures

FIG. 1
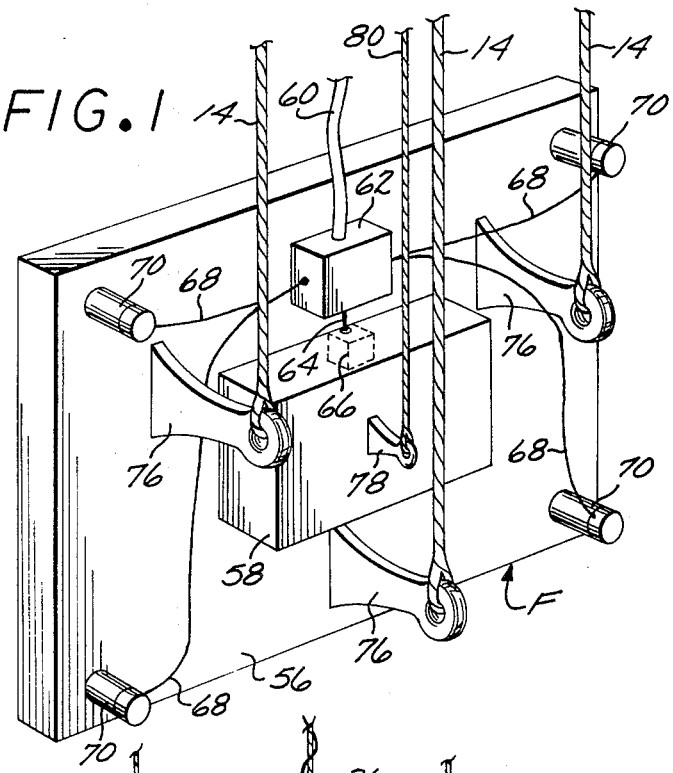
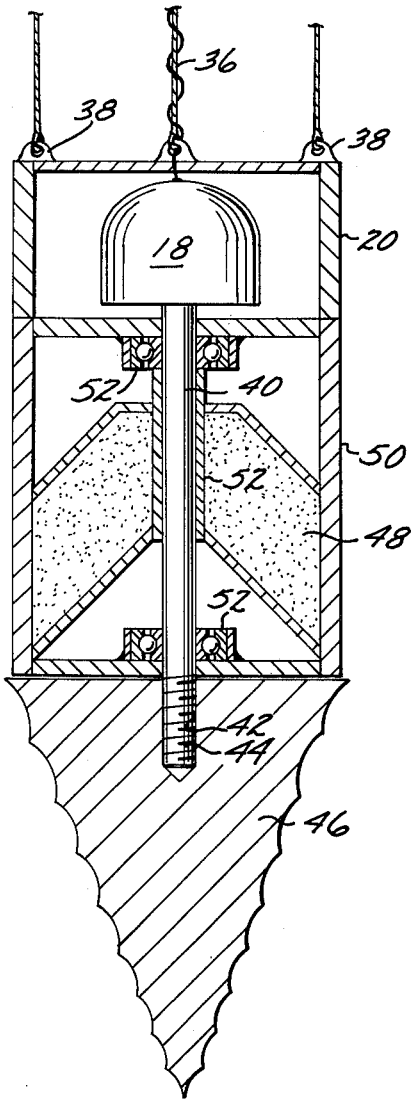
FIG. 2
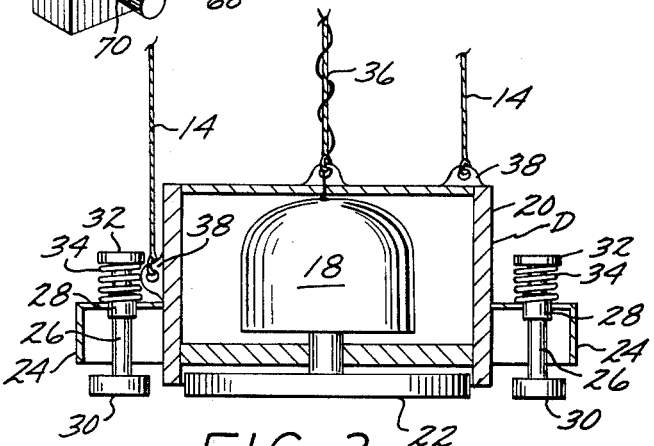
FIG. 3
FIG. 4
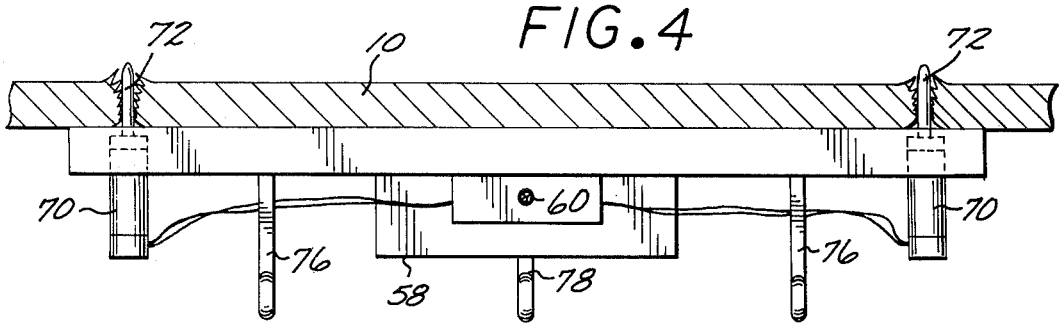

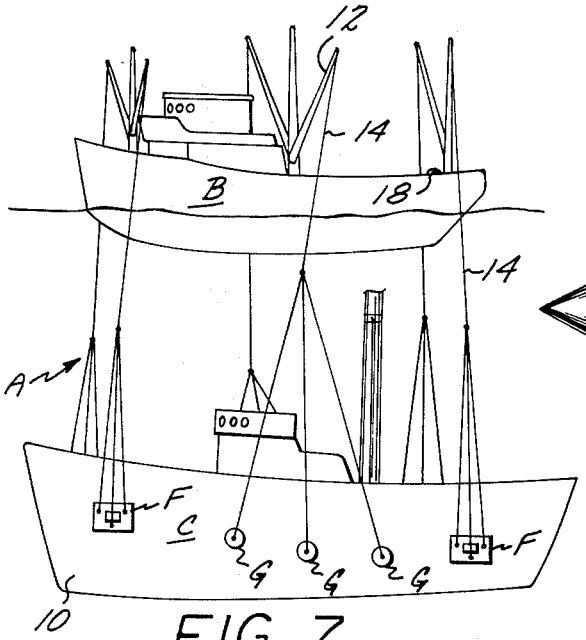
FIG. 7
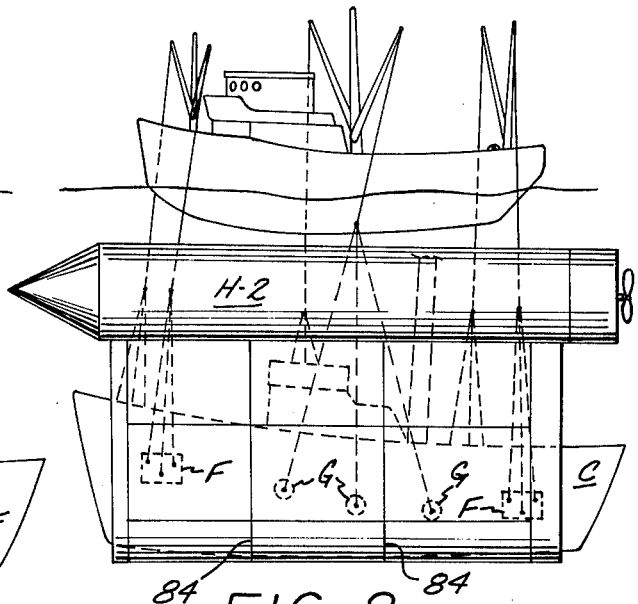
FIG. 8
FIG. 10
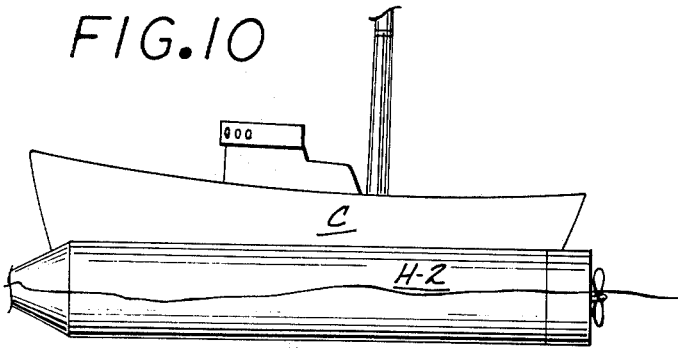
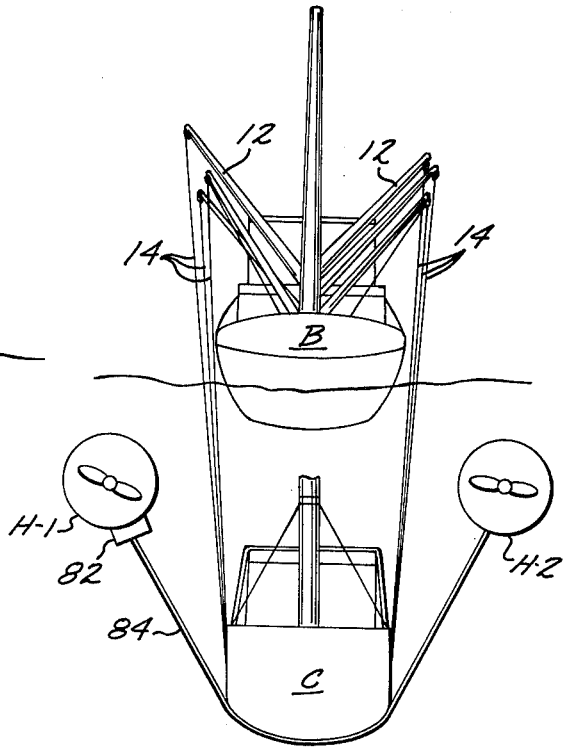
FIG. 9
FIG. 11
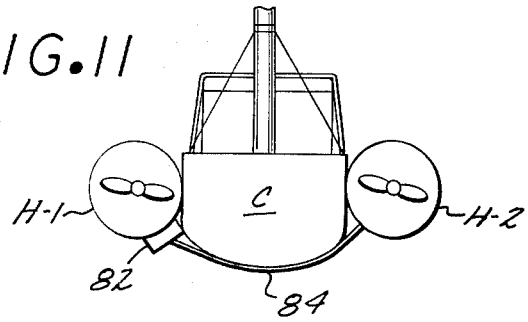

STEEL BOAT HULL SALVAGING ASSEMBLY

BACKGROUND OF THE INVENTION

1. Field of the Invention

Steel Boat Hull Salvaging Assembly.

2. Description of the Prior Art

In the past, in the salvaging of a sunken vessel, it has necessary for divers to descend and attempt to secure cables to the hull. The cables are subsequently tensioned to exert a sufficient upward force on the sunken vessel as to raise the latter to the ocean surface.

This prior art method of salvaging has numerous operational disadvantages. The prior art method requires numerous man-hours on the part of divers, which is extremely expensive, in that, but a small portion of this time is productive, for when the vessel being salvage is in deep water, a substantial portion of the diver's time is occupied in descending and ascending from a location adjacent the sunken vessel. In addition, the salvage operation is hazardous to divers, particularly where the divers are attempting to work at substantial depths.

In the prior art salvaging operations, the operation may be unsuccessful even if lifting cables are secured to the sunken hull, or the latter may have a substantial portion thereof embedded in the ocean floor and, in effect, anchored thereto. Under such conditions, when a strain is exerted on the lifting cables, the cables frequently break, or the cables separate from the sunken vessel.

A major object of the present invention is to provide an assembly of components that may be used with a salvage vessel to recover a sunken boat that has a steel hull, without the necessity of use of divers other than to locate the position of the sunken vessel on the ocean floor.

Another object of the invention is to permit the salvaging of sunken vessels without the attendant operational disadvantages above-described that are common to prior art salvaging methods.

SUMMARY OF THE INVENTION

The present salvaging invention requires the use of a salvage vessel that is provided with one or more power-operated winches that may raise and lower cables to positions adjacent the sunken vessel.

The salvage vessel, after the sunken vessel is located, lowers closed circuit television cameras of water-proof construction to locations adjacent the sunken vessel. Television cameras indicate that the sunken hull has a heavy growth of barnacles or other marine material thereon. One or more of the cables is used to lower water-proof motors that rotatably drive cutting elements to desired positions adjacent the hull. The cutting elements as they are driven remove barnacles and marine growth from desired sections of the hull.

Subsequently the cables are used to lower water-proof reversible motors that drive drills into locations in the ocean floor adjacent the hull. The drills are then rotated in an opposite direction to separate from the embedded drills, and the drills then drawn back to the salvage vessel. The drills and motors are so associated, that as the separation takes place, explosive charges with time delay detonators that initially formed part of the drill and motor assemblies are left with the drills on the ocean floor. The charges subsequently explode, and in so doing, jar the ocean floor adjacent the vessel sufficiently to break the bond between the vessel and ocean floor.

The cables are now used to lower steel plates that support a number of rivets or bolts that have explosive charges associated therewith, and the plates also supporting electromagnets. When the plates are disposed adjacent a portion of the hull that has been cleaned of barnacles and marine growth, the electromagnets are energized, with the plates being drawn into abutting contact with the hull. The explosive charges are now detonated and drive the rivets or bolts into the hull to secure the plates thereto. The electromagnets are removably secured to the steel plate and may be separated therefrom after the rivets or bolts carried by the steel plates have been driven into the steel hull. The separated magnets are now withdrawn by cables attached thereto to the salvage vessel, where they are subsequently removably affixed to other steel plates of the type previously described, and which plates are lowered to positions adjacent the sunken vessel to be secured thereto.

After the plates have been secured to the hull as above described, cables attached to the plates are tensioned, and with sufficient force to draw the sunken vessel towards the surface of the body of water in which the salvage vessel floats.

Two elongate containers that are propeller-driven and are of variable buoyancy are provided that support a net therebetween when the containers are in laterally spaced relationship.

Prior to the sunken vessel being raised to the ocean surface, the propeller-driven containers are disposed on opposite sides of the vessel, with the net extending thereunder. A mechanism that is power-operated on one of the containers is now actuated to reel the net into the confines of the container, with the containers being drawn into positions where they are in abutting contact with opposite sides of the hull. The buoyancy of the vessels of the containers is now increased, and the containers in conjunction with the cables secured to the hull cooperate to lift the sunken vessel to a position adjacent the salvage vessel at the surface of the ocean or body of water in which the salvage vessel floats.

BRIEF DESCRIPTION OF THE DRAWINGS

FIG. 1 is a perspective view of a lift line supported plate that has a number of transversely movable bolts supported thereon that may be driven into the steel hull of a sunken boat after an electromagnet mounted on the plate is electrically energized to magnetize the plate to cause the latter to temporarily assume a desired fixed position adjacent the hull;

FIG. 2 is a longitudinal cross-sectional view of an assembly operatively associated with a reversible electric motor, which assembly by cables may be lowered to a position adjacent a sunken vessel where the motor rotates a drill in a first direction to drill a hole in the ocean bottom on which the vessel rests, and the motor when reversed, separating from the drill and an explosive charge remaining with the drill, which charge subsequently explodes due to a time-delay detonator associated therewith;

FIG. 3 is a transverse cross-sectional view of a cable supported assembly that is motor driven and used for removing coral, barnacles, or other marine growth from the hull of a sunken vessel;

FIG. 4 is a transverse cross-sectional view of the plate shown in FIG. 1 after the bolts have been driven into a section of a hull of a sunken boat;

FIG. 7 is a side elevational view of a sunken vessel prior to being raised by the use of the components previously described that are controlled from a salvage vessel;

FIG. 8 is a side elevational view of the sunken vessel with air chamber supported net extending thereunder;

FIG. 9 is an end elevational view of the sunken vessel being raised by the net;

FIG. 10 is a side elevational view of the sunken vessel in the process of being raised to the ocean surface by the net; and FIG. 11 is an end elevational view of the pair of air chambers and net supporting the sunken vessel at the ocean surface.

DESCRIPTION OF THE PREFERRED EMBODIMENT

Figure 6:
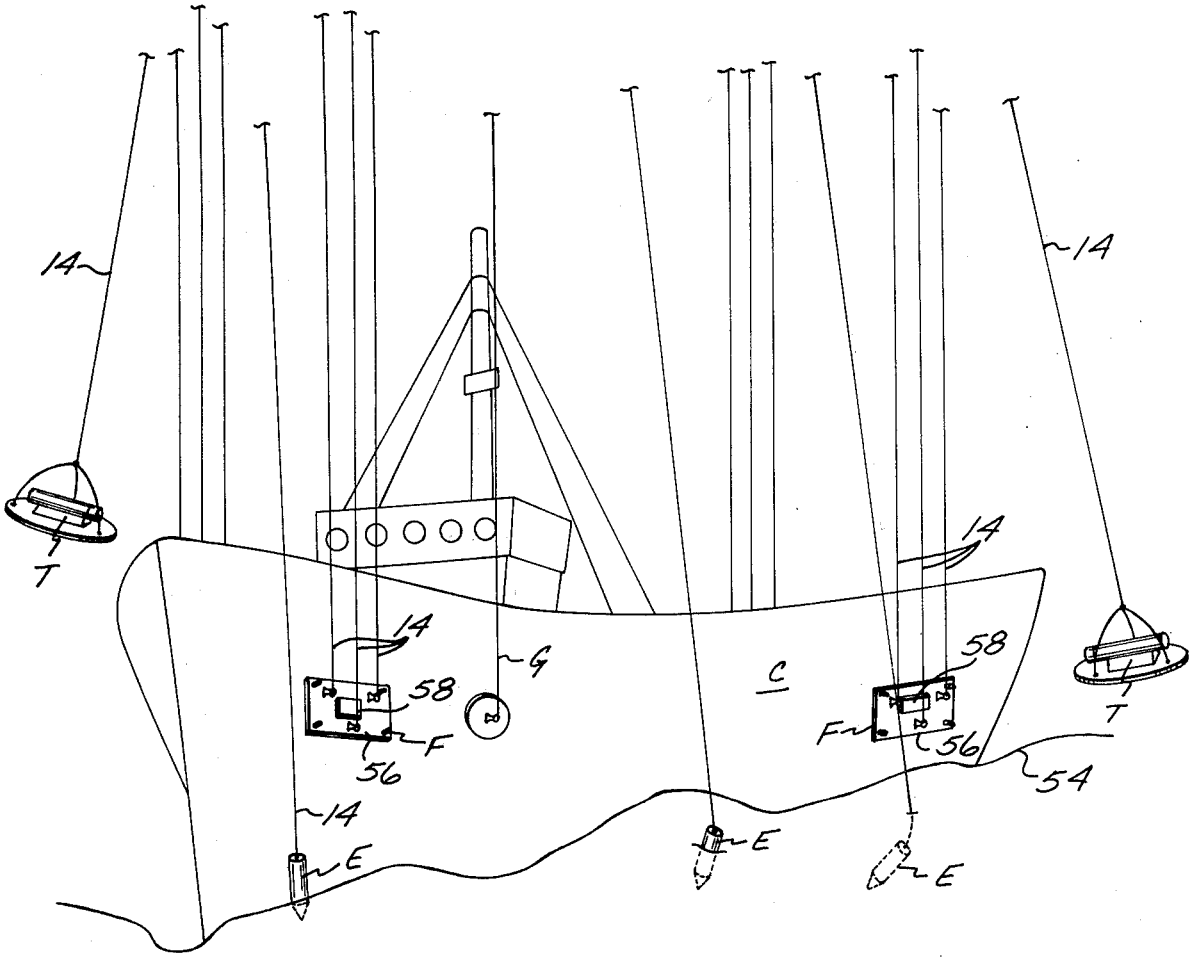
FIG. 6 is a perspective view of a sunken vessel with the components previously described being disposed in operative positions by the use of underwater closed television cameras.

The assembly of components A, as best seen in FIG. 6, are used in succession in connection with a salvage vessel B in raising a sunken vessel C that has a steel hull 10 from the bed of an ocean or other body of water in which the vessel C has sunk. The salvage vessel B is provided with a number of booms 12 that have cables movably extending therefrom, with the cables capable of being raised and lowered by power winches 16.

One of the components A is a reversible underwater motor assembly D. The motor assembly D includes a reversible waterproof motor 18 that is supported in a frame 20 as may be seen in FIG. 3, with the motor serving to drive a rotatable cutting member 22 to remove barnacles, coral or other marine growth (not shown) from the hull 10 when the cutting member 22 is brought in contact with the barnacles, coral or other marine growth. The frame 20 has two oppositely disposed L-shaped members secured thereto in which rods 26 are slidably supported in sleeves 28. The rods adjacent the cutting member 22 support strong permanent magnets 30. The opposite ends of the rod 26 have stops 32 mounted thereon, with the rods being encircled by helical springs disposed between the stops and the L-shaped members 24. An electric conductor 36 extends downwardly from the salvage vessel B to each of the motors 18. Each of the assemblies D is supported on the lower end of a pair of the cables 14 which are secured to the assembly by engaging eyes 38 as may be seen in FIG. 3.

Closed circuit television cameras T that are of waterproof construction, are supported by cables 14 and may be lowered to positions adjacent the sunken vessel C as may be seen in FIG. 6. The television cameras T permit an inspection of the hull 10 to determine whether it is heavily coated with barnacles, coral or other marine growth. In the event that it is so covered, one or more of the assemblies D will be lowered to a desired position adjacent the hull, and the permanent magnet 30 maneouvered into a position adjacent thereto. The permanent magnets are attracted to the steel hull and compress the springs 34 to move the frame 20, motor 18, and cutting member 22 towards the hull, with the cutting member as it thereafter rotates removing barnacles, coral or other marine growth from the hull to provide a clean space of desired area. Explosive charge carrying devices E may be lowered to positions adjacent the sunken vessel C by use of the cables 14. Each of the explosive charge carrying devices E as may be seen in FIG. 2 includes an elongate shaft 40 that is driven by one of the motors 18 situated within the frame 20, with the shaft having a threaded end portion 42 that engages a tapped bore 44 in a conical drill 46. A shaped explosive charge 48 is situated within the confines of a frame 50 that has bearings 52 through which the shaft 40 extends. When the explosive charge carrying device E has been lowered to a position adjacent the hull C as shown in FIG. 6, the electric motor 18 may be energized to rotate the drill 46 and cause the latter to become embedded in the ocean floor. The electric motor 18 is now reversed, with the shaft 40 unscrewing from the tap bore 44 and leaving the drill 46, the explosive charge 48 and the frame in place adjacent the hull C. As the frame 20, and motor 18 are separated from the explosive charge carrying frame 50, a time delay detonator (not shown) is energized, and the charge thereafter is exploded to loosen the hull C from the ocean floor 54 when the hull is a least partially embedded therein. The hull C when a sufficient number of the charges 48 have been detonated is no longer anchored to the ocean bed 54 by coral, barnacles or other marine growth, and is free to be lifted to the surface.

A number of magnetizable, rectangular, steel plate assemblies F are provided, one of which is shown in FIG. 1, that may be lowered to a position adjacent the sunken vessel C by use of the cables 14. Each of the assemblies S includes a rectangular steel plate 56 that has an electromagnet removably secured thereto, and the magnet capable of being electrically energized by a first elongate waterproof electrical conductor 60 that extends downwardly thereto from the salvage vessel B. The conductor 60 terminates in a distribution box 62 that has switching means (not shown) therein that permits the selective energization of the electromagnet 58. The switching means (not shown) also permits electric current when desired to fall through second conductors 64 to a first explosive charge assembly 66 that secures the electromagnet 58 to the rectangular steel plate 56. The switch means (not shown) also permits electric current to flow through third conductors 68 to second explosive charges 70, which second charges when detonated, drive rivets 72 into the steel hulls 10 as shown in FIG. 4, to secure one of the steel plates 56 to the hull. Prior to the rivets 72 being driven into the hull, the electromagnet 58 is electrically energized to magnetize the plate 56 and cause it to move to a position in abutting contact with a section of the hull after the plate 56 has been moved adjacent the hull. Moving of the plate to a selected position adjacent the hull 10 is carried out by concurrently viewing the hull and assembly F through one or more of the underwater television cameras T. Each magnetizable plate 56 is supported by a number of the downwardly extending cables 14 that, on their lower ends, are secured to gusset ears 76. A second gusset ear 78 extends outwardly from the electromagnet 58 and is secured to an upwardly extending cable 80. After the electromagnet has been electrically energized and the rivets 72 driven into the hull 10, electric current is caused to flow through a conductor 64 to explosive charge 66 to detonate the latter, and free the electromagnet 58 from the steel plate 56. The electromagnet is drawn to the surface by the cable 80 for subsequent use by attaching to a steel plate 56 as shown in FIG. 1 that will subsequently be lowered and attached to the hull 10 in the same manner as above described.

Figure 5:
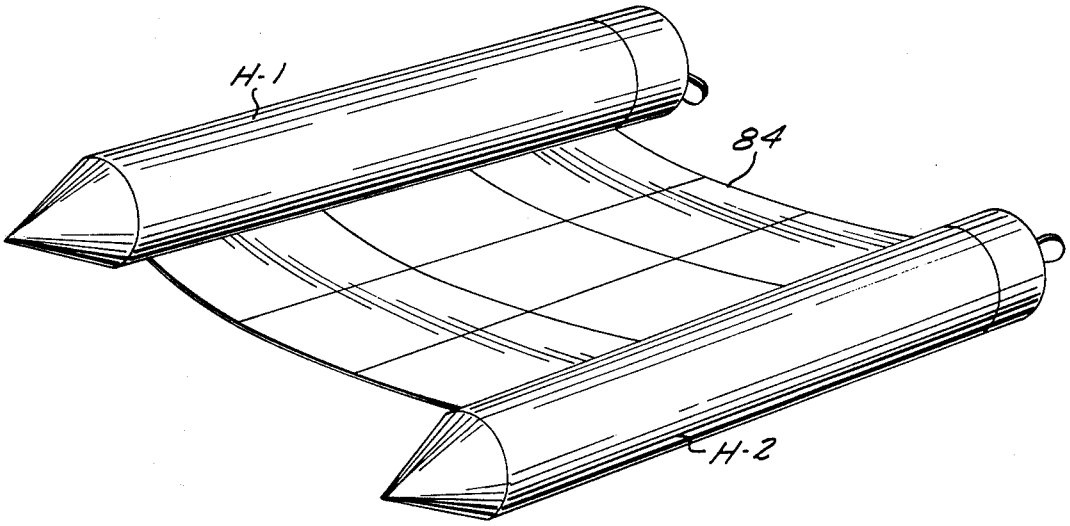
FIG. 5 is a perspective view of a pair of propeller driven air chambers that support a transversely extending net therebetween that may be varied in length by winch assemblies mounted on one of the chambers.

First and second elongate propeller driven bodies H-1 and H-2 are provided that contain compressed air, and are remote controlled and are of variable buoyancy. The first body H-1 contains a power driven winch 82 that may be actuated by remote control. The winch 82 is adapted to reel and unreel a number of transversely extending cables 84 or a net 84 that extends to the second body H-2. By use of the television cameras T, the bodies H-1 and H-2 are caused to assume the position shown in FIG. 5. After tension is placed on the cables 14 and the cables exert an upward force on the plates 56, and the bodies H-1 and H-2 are maneuvered by observation through the television camera T to the position shown in FIG. 9 where the cables extend under the sunken vessel C. The winch 82 is now energized, and the first and second bodies are brought into positions adjacent the sunken hull 10 as shown in FIG. 11 as the winch 82 reels the cables 84 into the confines of the first body H-1. Magnetizable circular steel plates G are provided that are the same general structure as the plate assemblies F, but differ therefrom in containing only one explosive charge that will drive a rivet into the sunken vessel C.

The use and operation of the invention has been explained previously in detail and need not be repeated.

I claim:

1. In combination with a salvage vessel that has a source of electric power thereon, a plurality of power operated cables movably supported in depending positions from said salvage vessel and capable of being raised and lowered relative thereto, and a plurality of power operated electrical inducing conduits depending from said salvage vessel that may be raised and lowered relative thereto, an assembly for raising a sunken vessel having a steel hull, said assembly including:

a. a closed circuit television system operatively associated with said salvage vessel said system including a waterproof camera supported from a first of said conduits, said camera capable of being lowered by one of said conduits to a position adjacent said sunken vessel to view the latter from said salvage vessel;

b. electric motor driven means supported by a plurality of said cables and powered through one of said conduits for removing foreign material from said steel hull when in pressure contact with said foreign material;

c. magnetic means for moving said electric motor driven means towards said hull to clean said foreign material therefrom and provide a plurality of clean spaced areas on said hull; and d. a plurality of fastening assemblies that may each be lowered by a plurality of said cables to positions adjacent said cleaned areas, each of said fastening assemblies including:

1. a heavy steel plate secured to at least one of said cables;

2. an electromagnet removably secured to said plate, said electromagnet in communication with one of said conduits, and said plate being magnetized when said electromagnet is energized;

3. a plurality of transversely disposed fastening members mounted on said plate and capable of moving a distance less than that of their length relative to said plate;

4. a plurality of electrically detonable explosive charges on said plate which when exploded drive said members partially into said hull when said plate is held in abutting contact with said hull by said plate being magnetized; and 5. switching means connected to said conduit, electromagnetic and explosive charges for first energizing said electromagnet with electric power from said conduit, second for directing electric power to said explosive charges to detonate the latter and third de-energizing said electromagnet to permit the latter to be separated from said plate and drawn aboard said salvage vessel by use of one of said cables attached to said electromagnet, and said sunken vessel being raised when said cables attached to said plates are tensioned and moved upwardly to raise said sunken vessel to the surface of the body of water on which said salvage vessel floats.

e. first and second elongate containers of variable buoyancy that include remote controlled power means for driving said first and second containers in laterally spaced relationship through the body of water on which said salvage vessel float;

f. a plurality of flexible elongate members that extend between said containers; and g. power means on said first container for reeling said flexible elongate members into the confines thereof when said first and second containers are disposed on opposite sides of said sunken vessel when said sunken vessel is in a partially raised position, with said flexible elongate members as they are reeled in drawing said containers to positions adjacent opposite sides of said sunken vessel, and said flexible elongate members cooperating on a cradle to partially support said sunken vessel as the latter is moved towards the surface of said body of water by increasing the buoyancy of said containers.

2. A sunken vessel raising assembly as defined in claim 1 which in addition includes:

h. a device for burying an explosive charge in the bottom on which said sunken vessel rests adjacent said sunken vessel, said device comprising;

1. a first frame supported on the lower ends of a plurality of said cables;

2. a reversible electric motor with a depending drive shaft that has a lower threaded end with said motor supported from said first frame, said motor being supplied with electric power from one of said conduits that extends thereto;

3. a second frame removably secured to said first frame;

4. an explosive charge supported on said first frame;

5. a drill that has a tapped bore that engages said threaded end of said drive shaft, said drill becoming embedded in said bottom when said drive shaft rotates in a first direction, and said first frame and motor separating from said second frame, explosive charge and drill when the direction of rotation of said drive shaft is reversed and said cables attached to said first frame are tensioned and pulled upwardly; and 6. a time delay detonator that is actuated when said first and second frames separate, said time delay detonator subsequently exploding said explosive charge to free said sunken vessel from said bottom on which said sunken vessel rests.

* * * * *